United States Patent [19]

Vogel

[11] 4,077,389

[45] Mar. 7, 1978

[54] PNEUMATIC OVEN DOOR GASKET

[75] Inventor: K. Stuart Vogel, Fort Worth, Tex.

[73] Assignee: Jamak Incorporated, Weatherford, Tex.

[21] Appl. No.: 677,892

[22] Filed: Apr. 19, 1976

[51] Int. Cl.[2] ..... F24C 15/04

[52] U.S. Cl. ..... 126/190; 277/26

[58] Field of Search ..... 126/190; 49/479, 482, 49/477; 277/26, 34.3, 226; 220/232, 240, 378

[56] References Cited

U.S. PATENT DOCUMENTS

| | | | |
|---|---|---|---|
| 2,823,660 | 2/1958 | Holzboog et al. | 126/190 |
| 3,023,466 | 3/1962 | Landis | 49/479 |
| 3,029,805 | 4/1962 | Scott | 126/190 |
| 3,099,259 | 7/1963 | Newell, Jr. | 126/190 |
| 3,404,675 | 10/1968 | Payne | 126/190 |
| 3,765,400 | 10/1973 | Meier et al. | 126/190 |

FOREIGN PATENT DOCUMENTS

| | | | |
|---|---|---|---|
| 576,206 | 3/1946 | United Kingdom | 277/26 |

*Primary Examiner*—John J. Camby

*Assistant Examiner*—Larry I. Schwartz

*Attorney, Agent, or Firm*—Silverman & Cass, Ltd.

[57] ABSTRACT

A pneumatic gasket adapted to be used in an oven door construction in which the door is adapted to be sealed to an oven surface when the door is closed. The gasket is an elongate extensile elastomeric member with first and second sections. The second section is a hollow member which is sealed at its ends or at other desired locations, the space between each of these sealed points forming a hollow air chamber of substantial volume which will expand when exposed to the temperatures produced by an operating oven. The second section may be sealed to produce the air chambers by adhesives such as a room temperature vulcanizing adhesive or by mechanical means. The second section may be a coextensive flap hingedly secured along one edge of the first section. The gaskets have means connected to the first sections removably to secure them to the oven surface to hold them in place between the oven and the door, while allowing them easily to be removed to replace them or to clean the oven.

7 Claims, 10 Drawing Figures

PNEUMATIC OVEN DOOR GASKET

BACKGROUND OF THE INVENTION

The invention relates to a gasket primarily adapted for sealing the doors of cooking ovens and more specifically to a novel gasket having one or more air chambers for effecting such sealing.

A removable gasket with a flap hingedly connected along one edge has been previously proposed to provide a seal for oven doors. One such gasket which is adapted removably to be secured to an oven door is disclosed in U.S. Pat. No. 3,765,400. The flat flap of this gasket extends outwardly from the oven face when the gasket is installed so that it will be engaged by the door surface and compressed to form a seal therebetween; however, this flap may not engage fully or tightly along its length to give a complete seal.

The invention provides a gasket with a second section or flap which includes an air chamber. When the oven door is closed and the oven is operating, the oven operating heat expands the air and improves the seal by expanding the gasket thickness between the surface of the door and the oven face.

SUMMARY OF THE INVENTION

The above and other disadvantages of prior art oven gaskets and oven sealing techniques are overcome in accordance with the present invention by providing a gasket having an air chamber or chambers which will expand when exposed to oven operating temperatures. The gasket comprises an elongate gasket member with a first section incuding means for securing the gasket to an oven door. A second section includes the air chambers and may be a hinged flap integral with the first section. The second section includes one or more hollow air chambers which are sealed at their ends by a room temperature vulcanizing adhesive, or other sealing means such as a mechanical closure.

DESCRIPTION OF THE PREFERRED EMBODIMENTS

According to the invention, a sealing structure is achieved by means of a plurality of gaskets which are emovably secured to the face of an oven around the opening of the cooking chamber which is to be closed by an oven door. The door is swung into position over the opening, engaging the gaskets around the opening, which gaskets have one or more air chambers which contain a substantial amount of air which expands when exposed to heat. The air chambers thereby seal the opening to reduce the loss of heat from the oven during operation. The ends of the air chambers are preferably sealed by means of room temperature vulcanizable (RTV) adhesive.

Figure 1:
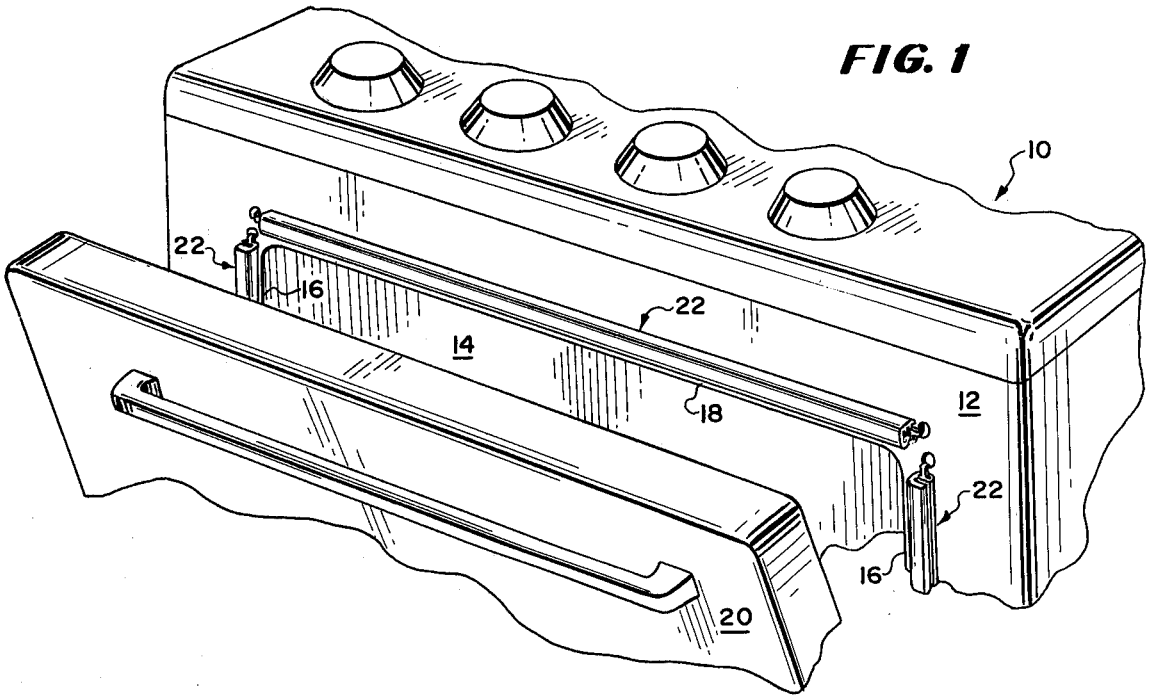
FIG. 1 is a fragmentary front perspective view of a cooking oven having gaskets connected thereto which are constructed in accordance with the invention.

In FIG. 1 there is partially illustrated an oven 10, having a front framing wall 12 and provided with a cooking chamber 14 which has an opening defined by sides 16 and a top edge 18. There is a conventional oven door 20 hingedly connected (not shown) to the oven 10 and suitably sprung (not shown) to enable its being swung over the cooking chamber 14 to confront the face or surface of the wall 12 or swung away from the opening of the chamber 14 to give access to the cooking chamber. The exact construction of the door and its mechanism is of no consequence to the invention, except for the fact that the interior surface 21 (FIG. 6) of the door 20 is intended to engage upon the gaskets 22 placed around the opening of the cooking chamber 14.

The gaskets 22 are shown engaged adjacent the sides 16 and adjacent the top edge 18 of the opening of the oven cooking chamber 14. These three sides of the cooking chamber opening are the ones usually sealed. Each of the gaskets 22 is constructed in the same manner; however, the upper gasket may be somewhat longer than the other two. Each of the gaskets 22 is easily installed and readily removable, for cleaning the wall 12 of the oven or for replacing the gaskets. The gaskets 22 will preferably be made of an extruded heat-resisting elastomer, such as silicone rubber.

Figure 2:
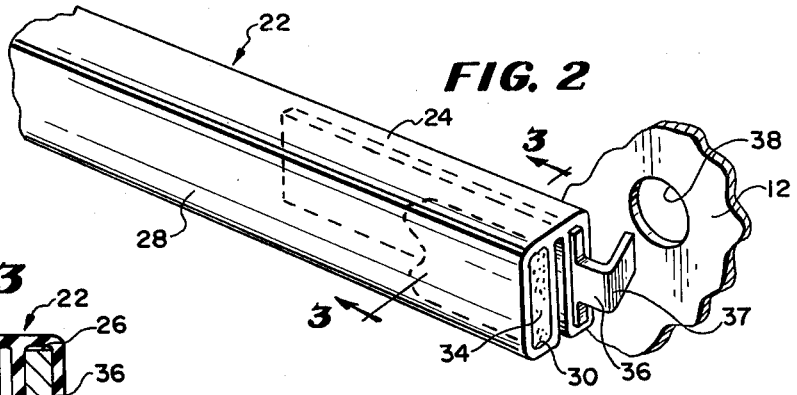
FIG. 2 is a fragmentary enlarged perspective view of a preferred embodiment of the gasket.
Figure 3:
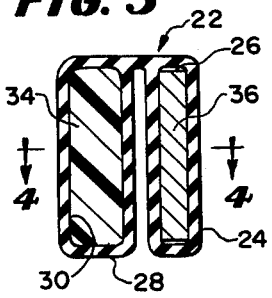
FIG. 3 is an enlarged sectional view taken through the gasket of FIG. 2 along the line 3—3 and in the direction indicated.
Figure 4:
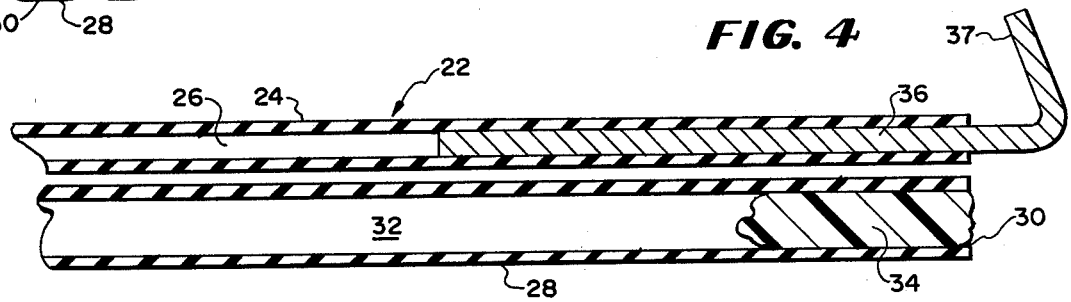
FIG. 4 is a sectional view taken through the gasket of FIGS. 2 and 3 along the line 4—4 of FIG. 3 and in the direction indicated.

The construction of the gaskets 22 and the preferable securing means are best seen in FIGS. 2–4. The gasket 22 is comprised of a first section, an elongate rectangular cross section tubular member 24 of elastomeric material, such as for example silicone rubber or the like having a central bore 26 (FIG. 4). The gasket 22 has a second section integral with the first section. The second section preferably is an exterior protruding flap 28 hingedly connected along one edge of the first section. In U.S. Pat. No. 3,765,400 a hinged flap is provided; however it is a thin, flat member intended to extend outwardly when the gasket is installed so that it can be engaged by the surface of the door 20 and compressed to form the seal.

The invention contemplates the provision of a hollow bore 30 in the second section or flap 28 which is sealed by the described sealing method to provide a hollow air chamber or chambers 32 which entrap a substantial volume of air or other expandable fluid. A preferable method of sealing the air chambers 32 is to insert globules of RTV cement in the bore 30 and permit them to vulcanize to form a plug 34 of solidified but elastomeric material in the bore 30 at the desired locations. The air chambers 32 between the plugs 34, or other type of closures, will expand when exposed to heat to enhance the sealing of the cooking chamber 14.

There are known securing means to secure the gaskets 22 to the wall 12 of the oven. The securing means illustrated in FIGS. 2-4 are described in U.S. Pat. No. 3,765,400. Each end of each gasket 22 has a metal insert 36 engaged in the hollow bore 26. Each of the inserts is an elongate strip of metal having an integral hook 37 formed on one end. Securement of the metal insert 36 within the hollow bore 26 is achieved by means of RTV adhesive bonding the insert 36 in place. The portion of the bore 26 not filled by the RTV or the insert 36 may leave a small amount of trapped air, but it does not enhance the sealing of the cooking chamber 14 as do the air chambers 32 of the invention.

"Substantial" as used herein to define the size of the air chamber 32 and the quantity of entrapped air is intended to mean, that the quantity of air will be such that on expansion by oven heat, the width of the gasket will expand measurably or the gasket will acquire a pressure internally capable of resisting compression. The gaskets 22 are extensile or stretchable material formed of a uniform cross section by extrusion. This enables the two sections of the gaskets 22 to be formed integrally and cheaply.

In use, the gaskets 22 may be secured to the wall 12 by any known mounting technique; however, as shown in FIGS. 1 and 2, the wall 12 may be provided with perforations 38. There would be a pair of perforations for each side of the opening of the oven chamber 14 which is to have a gasket connected thereto. Utilizing as a securing means, the previously mentioned inserts 36, the distance between the pair of perforations 38 is made slightly greater than the length of the gasket 22. To install the gasket, the assembler stretches the gasket endwise and hooks the hooked formations 37 into the respective perforations 38. This applies tension to the gasket and keeps it engaged against the wall 12.

Each gasket 22 may be easily stretched and removed to clean the oven or to replace the gasket. In place of the securing means or inserts 36 there has also been provided, in the prior art, a metal piece (not shown) which is extended through the entire length of the central bore 26. The ends of the metal piece or strip were flexed or bent to insert them in the suitably placed perforations 38.

Figure 5:
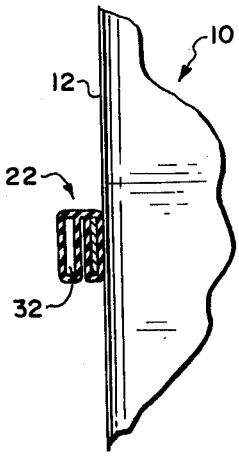
FIG. 5 is an enlarged sectional view taken through an unexpanded air chamber of the gasket mounted on an oven.
Figure 6:
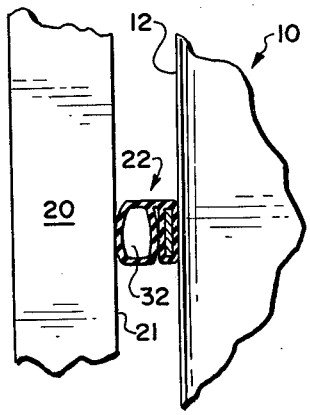
FIG. 6 is a view similar to FIG. 5 but showing the gasket in an expanded state.

FIGS. 5 and 6 illustrate the operation of the air chamber 32 of the gasket 22. The gasket 22 is mounted to the surface of the wall 12 of the oven 10 by any suitable method. Only one of the gaskets 22 is illustrated; however, there would typically be three mounted around the cooking chamber 14 as shown in FIG. 1. In FIG. 5 the air chamber 32 is illustrated at room temperature with the oven door swung away from the surface. In FIG. 6 the air chamber is illustrated in its operative form providing a seal between the oven face and the interior surface 21 of the closed oven door 20. The seal is formed by the expansion of the fluid contained within the air chamber 32 as the oven 10 is heated to its operating temperature. The air chamber or chambers 32 expand to form a tight seal between the surface 21 of the door 20 and surface of the wall 12 of the oven to provide an efficient and energy conserving oven operation.

Figure 7:
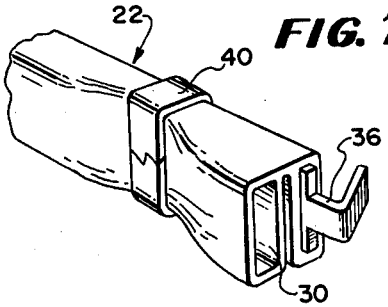
FIG. 7 is a partial perspective view of the gasket showing one type of air chamber closure.
Figure 8:
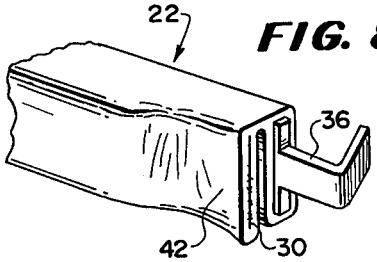
FIG. 8 is a view similar to that of FIG. 7 but showing a different type of air chamber closure.

FIGS. 7 and 8 show two other types of closure for the hollow bore 30. In FIG. 7 there is illustrated a mechanical closure 40. In this case the air chamber 32 is sealed by the mechanical closure by clamping the mechanical closure 40 around the gasket 22. In FIG. 8 there is illustrated a closure 42 where the end of the bore 30 of the gasket 22 is pinched and sealed in this condition, for example, by an adhesive or heat welding.

Figure 9:
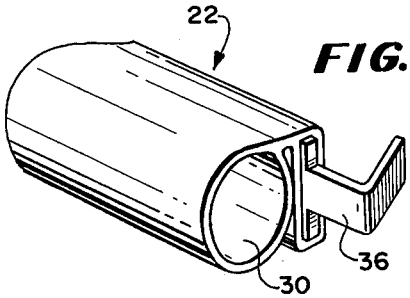
FIG. 9 is a view similar to that of FIGS. 7 and 8 with the flap not yet sealed.

FIG. 9 illustrates the bore 30 of the gasket 22 before it is sealed. In this embodiment the bore 30 is cylindrical rather than rectangular as previously illustrated. The bore 30 could of course have any convenient shape and when sealed by an adhesive such as the RTV, the shape of the seal may not be perfectly cylindrical or rectangular.

Figure 10:
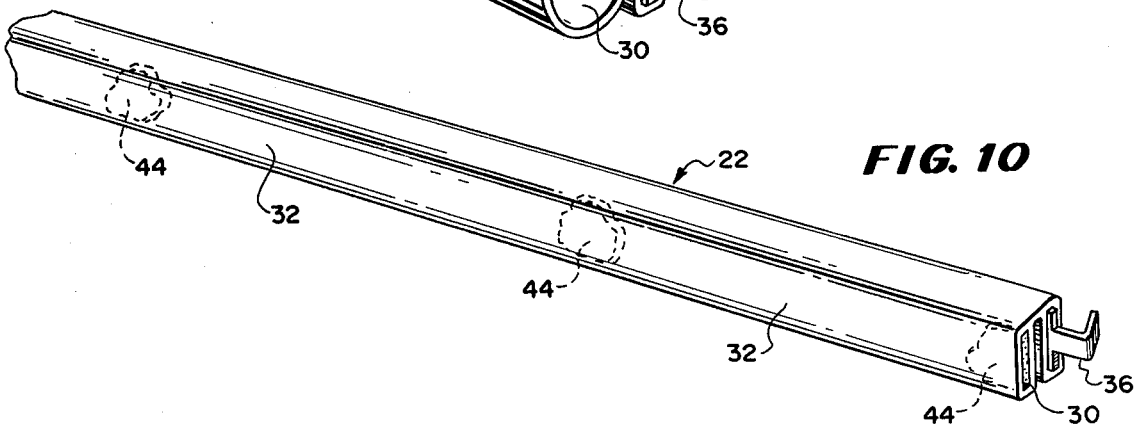
FIG. 10 is a perspective view of the invention showing air chambers at various points along the length of the gasket.

FIG. 10 shows the gasket 22 with multiple seals or closures 44 in the bore 30 forming multiple hollow air chambers 32. The multiple seals 44 preferably may be formed by injecting an adhesive such as RTV into the hollow bore 30 to plug the bore where desired. The volume of the air chamber or chambers 32 is thus easily controlled and the chambers may be located anywhere along the length of the gasket as desired.

RTV adhesive is well known and there are many formulations available on the market. Almost any general adhesive of this type may be used. It is typically intended to be vulcanized at room temperature. The invention does not exclude adhesives which can be cured by the use of elevated temperatures alone or under moist conditions. It should be noted that the gasket 22, during its eventual use, is subjected to the heat of the oven itself and this serves further to vulcanize the bond of the inserts 36 and the plugs 34, where used, of the air chambers 32.

Modifications and variations of the present invention are possible in light of the above teachings. It is, therefore, to be understood that within the scope of the appended claims, the invention may be practiced otherwise than as specifically described.

What it is desired to secure by Letters Patent of the United States is:

1. In an oven construction including in combination an oven including a door and a frame having confronting surfaces, and means for sealing the door when closed against the surface of the frame, said means comprising:

at least one elongate gasket member of elastomeric material having a first and a second section;

means for securing said first section in engagement along one of said confronting surfaces; and said second section including elongate hermetic air chamber means, said chamber means having a substantial volume variable in response to temperature for selective expansion of the second section into sealing engagement between the first section and the second confronting surface when subjected to the heat of said oven.

2. The construction as claimed in claim 1 wherein:

said securing means include inserts having hook formations secured in said first section of said gasket member;

the oven frame has hook receiving means; and said gasket member is an extensile member.

3. The construction as claimed in claim 1 wherein:

said air chamber means are sealed at each end by RTV adhesive.

4. The construction as claimed in claim 1 wherein:

said air chamber means are formed of a plurality of independently sealed sections.

5. The construction as claimed in claim 1 wherein:

said securing means are constructed to enable said gasket member to be removed from said one of said surfaces.

6. The construction as claimed in claim 1 wherein:

said second section is a flap hingedly connected to said first section along one edge thereof.

7. The construction as claimed in claim 1 wherein:

said gasket member is an extensile member;

said oven frame has hook receiving means;

said securing means include inserts having hook formations secured in said first section by RTV adhesive to enable said gasket member to be removed from said one of said surfaces; and said second section is a hollow bore hingedly connected to said first section along one edge thereof, said hollow bore being sealed by RTV adhesive at least at two separate places to form said air chamber means therebetween.

* * * * *